US005676083A

United States Patent [19]

Korsgaard

[11] Patent Number: 5,676,083

[45] Date of Patent: Oct. 14, 1997

[54] OFFSHORE MOORING DEVICE AND METHOD OF USING SAME

[76] Inventor: Jens Korsgaard, 318 N. Post Rd., Princeton Junction, N.J. 08550

[21] Appl. No.: 581,652

[22] Filed: Dec. 29, 1995

[51] Int. Cl.[6] ..... B63B 22/02

[52] U.S. Cl. ..... 114/230; 114/293; 441/4

[58] Field of Search ..... 441/3–5; 114/293, 114/230, 179, 181

[56] References Cited

U.S. PATENT DOCUMENTS

| | | | |
|---|---|---|---|
| 704,155 | 7/1902 | Walters | 114/181 |
| 3,722,223 | 3/1973 | Gratz | 441/4 |
| 3,860,983 | 1/1975 | Furth et al. | 441/2 |
| 4,406,636 | 9/1983 | Van Heijst | 441/5 |
| 4,604,961 | 8/1986 | Ortloff et al. | 441/5 |
| 4,765,378 | 8/1988 | Engelskirchen et al. | 441/5 |
| 5,305,703 | 4/1994 | Korsgaard | 114/230 |
| 5,380,229 | 1/1995 | Korsgaard | 441/3 |
| 5,447,114 | 9/1995 | Korsgaard | 441/230 |
| 5,515,803 | 5/1996 | Korsgaard | 441/4 |

*Primary Examiner*—Sherman Basinger
*Attorney, Agent, or Firm*—Kenyon & Kenyon

[57] ABSTRACT

A mooring system preferably for oil transport, production, and drilling vessels in the ocean, and a method of using the system. The mooring system combines a submerged buoyant element anchored to the seabed with a retrieval system aboard the vessel and a mechanism to secure the submerged mooring element to the hull of the vessel by reducing the hydrostatic pressure in a volume isolated from the sea by the mooring element and the hull of the vessel. The mooring element may by non-circular, to allow use with smaller vessels while still providing sufficient retaining forces. The mooring element can be configured so that the mooring element aligns with the hull of the vessel as it is hoisted by the vessel.

40 Claims, 9 Drawing Sheets

OFFSHORE MOORING DEVICE AND METHOD OF USING SAME

BACKGROUND OF THE INVENTION

1. Field of the Invention

The present invention relates generally to the mooring of oil transport, production, and drilling vessels in the ocean. More particularly, the invention relates to a mooring system which combines a submerged buoyant element anchored to the seabed with a retrieval system aboard the vessel and with a mechanism to secure the submerged mooring element to the hull of the vessel by reducing the hydrostatic pressure in a volume isolated from the sea by the mooring element and the hull of the vessel.

2. Description of the Prior Art

Moorings of the type set forth in the present invention are described in U.S. Pat. Nos. 5,305,703, 5,380,229, and 5,447,114. The moorings in the above-referenced patents are all of the submersible buoy type, in which a mooring buoy that is normally submerged to a depth below the draft of the vessel is brought into contact with the keel of the vessel, by being lifted by a retrieval line, by being deballasted with a compressed gas, or by a combination of these methods. Following contact of the mooring buoy with the keel of the vessel, the buoy is secured to the vessel by reducing the hydrostatic pressure in the volume isolated by the vessel and the mooring buoy, thereby pressing the mooring buoy onto the hull of the vessel with a large force. The resulting friction between the mooring buoy and the hull of the vessel moors the vessel.

The moorings in the referenced patents are generally circularly symmetrical and the retrieval rope, the fluid transfer equipment and the intake to create the lowered hydrostatic pressure usually occupies the same general volume at the center of the mooring buoy.

SUMMARY OF THE INVENTION

An object of the present invention is to provide an improved mooring system of the single point mooring type described in U.S. Pat. Nos. 5,305,703, 5,339,760, and 5,447,114, in which the retrieval line is not centered in the mooring buoy, thereby allowing placement of the retrieval system remote from the cargo transfer system on the vessel.

It is further the object of the present invention to make it possible to make the mooring recess on the vessel elliptical, rectangular, triangular or similarly oblong to increase the possible mooring force, particularly for small ships having a width of less than 25 meters.

Yet another object is to make it possible to remove the cargo transfer equipment from the mooring recess, possibly even beyond the hull of the vessel, to reduce the cost of modification of existing vessels to be able to use the mooring system.

The mooring system described in U.S. Pat. No. 5,305,703 includes a mooring buoy that is normally circular. Because the buoy is held by hydrostatic pressure against the flat portion of the hull at the keel, the diameter of the buoy must necessarily be less than the width of the flat portion of the hull at the keel of the vessel to be moored.

Therefore for relatively small vessels such as for example a 10,000 DWT vessel with a width of 18 meters the mooring buoy diameter cannot practically exceed about 14 meter. Such a buoy would have a surface area of 150 $m^2$. In ballasted condition the mooring recess is likely to be submerged approximately 2.5 meters. Assume that the mooring recess hydrostatic pressure can be reduced to 50 kPa absolute pressure through the means aboard the vessel to lower the pressure. The total attractive force between the buoy and the vessel is then (125–50) kPa*150 $m^2$=11.25 MN. Assume further that the coefficient of friction between the vessel and the mooring buoy is 0.5; if so, then the maximum horizontal mooring force that can be resisted is 5.6 MN. For the referenced vessel, this would normally be adequate, except in the most extreme weather conditions.

For even smaller vessels, such as barges and vessels of 7,000 DWT or less, the combined effects of reduced possible maximum buoy diameter and reduced absolute hydrostatic pressure at the keel combine to limit the practical application of this mooring technology for small vessels.

Another practical limitation arises from the need of having the retrieval line in the center of the buoy and of having the cargo transfer piping in the center of the buoy. The space required for these items generally does not reduce in size when the buoy diameter is reduced.

Ordinarily the mooring system is arranged so that the pressure can be raised in the center of the buoy while the buoy is moored, for example for the purpose of maintenance operations. If, for example, the area where the pressure can be raised has a diameter of 6 meters then 30 $m^2$ in the center has elevated pressure and the effective area available to press the buoy onto the hull is 120 $m^2$. In the example of a 10,000 DWT vessel above, this causes a reduction in available horizontal mooring force of 20%, to 4.5 MN.

In the event that the mooring buoy is rectangular, in accordance with the teachings of the present invention, and has dimensions 14 m×28 m, then the surface area is 392 $m^2$. For the example of a 10,000 DWT vessel above, this results in an attractive force of 392 $m^2$*75 kPa=29.4 MN. Assuming the same friction coefficient of 0.5 the possible horizontal mooring force becomes 14.7 MN which far exceeds what is normally required.

Because the mooring buoy is rectangular it is necessary to align the buoy and the vessel such that the longitudinal axis of the vessel coincides with the longitudinal axis of the rectangular mooring buoy. To achieve this, the retrieval line is placed on the longitudinal axis of the rectangular buoy, but off the center of rotation of the rectangle.

The retrieval line is retrieved though a fairlead at the keel of the vessel located towards the center of the vessel from the center of rotation. When the mooring buoy is retrieved the vessel is moored through the retrieval line and normally the vessel will stream out so that the mooring buoy, the force vector from the anchor lines, and the retrieval line are all aligned, thereby aligning the longitudinal axes of the mooring buoy and the vessel.

When the axes are aligned, the pressure reducing apparatuses on the vessel are engaged and the mooring buoy is thereby secured to the vessel. In the event that the current, wind, and wave forces combine to force the vessel into a heading that does not align the mooring buoy with the vessel, then the vessel's propulsion system will be operated so as to effect the alignment.

The present invention includes a submerged mooring element that is engageable to the mooring recess of a vessel equipped with an apparatus to reduce the hydrostatic pressure in the mooring recess similar to the vessels described in U.S. Pat. No. 5,305,703. The present invention also includes a winch for retrieval of the mooring element by pulling a retrieval line attached to the mooring element through a fairlead at the keel of the vessel, where the fairlead is off center to the mooring recess, and possibly located outside said mooring recess.

DETAILED DESCRIPTION OF THE INVENTION

Figure 1:
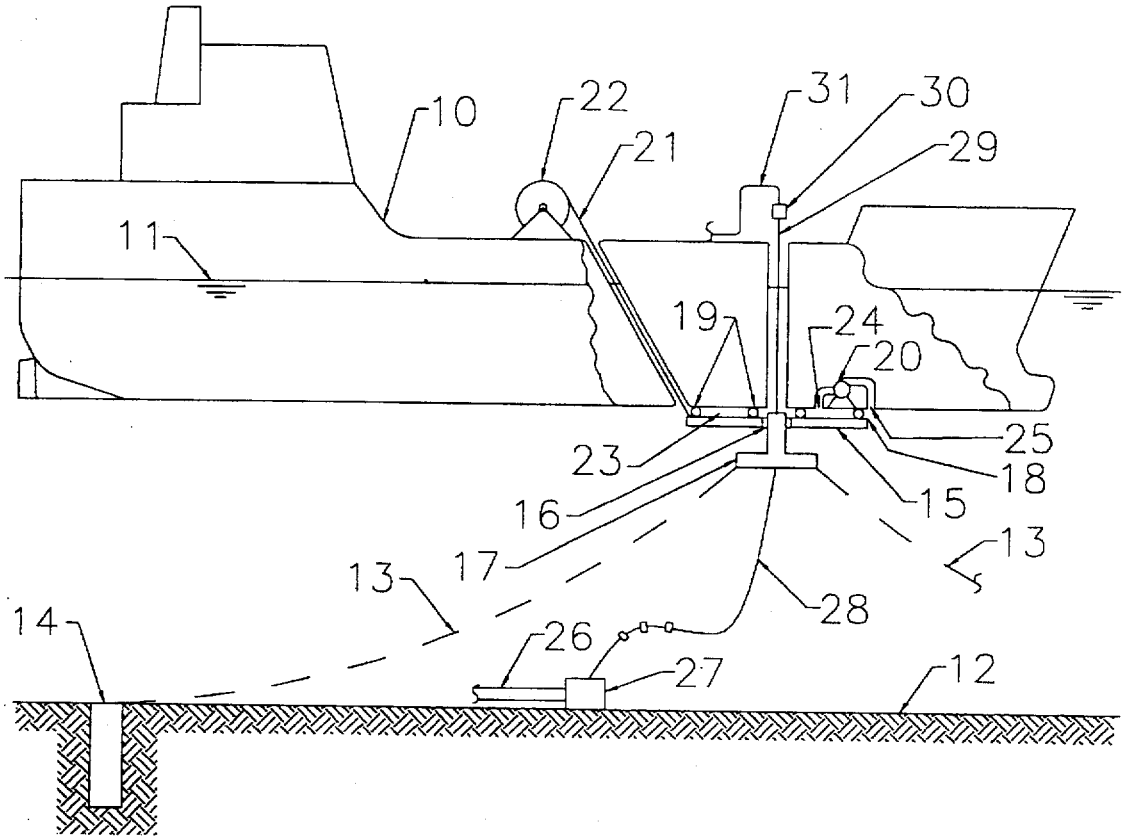
FIG. 1 shows a side view of a first embodiment of the present invention, wherein the buoy is attached to the keel of a vessel.

FIG. 1 shows a vessel 10 floating in the sea with a surface 11. The vessel 10 is moored by a submerged mooring element 15 that is attached to the hull of vessel 10 by two mechanisms: (a) by a retrieval line 21 being pulled by a winch 22 on the vessel 10 and (b) by the mooring element 15 being in sealing contact, through the seals 19, with the hull of the vessel 10 thereby isolating a volume from the sea within the mooring recess 23. The pump 20 has its intake 24 within the mooring recess 23 and its discharge 25 outside this recess. The pump 20 lowers the hydrostatic pressure between the hull of the vessel 10 and the mooring element 15 and the resulting hydrostatic pressure differential thereby forces the mooring element 15 onto the hull of the vessel 10. The device illustrated in this figure for lowering the hydrostatic pressure above the mooring element 15 is the pump 20, however, any of the mechanisms described in U.S. Pat. No. 5,305,703 could also be used, such as a hermetic vessel with a vacuum and a valve between the hermetic vessel and the mooring recess. The resulting friction between the mooring element 15 and the vessel 10 serves as a means to transmit horizontal forces and the hydrostatic pressure differential serves to transmit vertical forces.

The mooring element 15 is anchored to the sea bed 12 by anchor lines 13 attached to anchors 14. The mooring element 15 includes two parts 17 and 18 separated by a bearing 16 which permits the two parts 17 and 18 to freely rotate relative to each other. The part 18 remains rotationally fixed relative to the vessel 10 and the part 17 remains rotationally restrained relative to the sea bed 12 by the anchor lines 13. This permits the vessel 10 to freely weather vane in response to changing wind, wave, and current conditions. The vessel 10 may be an oil tanker that transfers cargo to or from a submarine pipeline 26.

The flow path between the cargo piping 31 aboard the vessel 10 is through a fluid swivel 30 aboard the vessel and a coupling pipe 29. The coupling pipe 29 is attached to a fluid connector (not shown) on the mooring element 15. The flow path continues via internal piping (not shown) in the mooring element 15 to a flexible riser 28, connecting to a pipeline end manifold 27 on the sea bed 12 which connects to the submarine pipeline 26.

Figure 2:
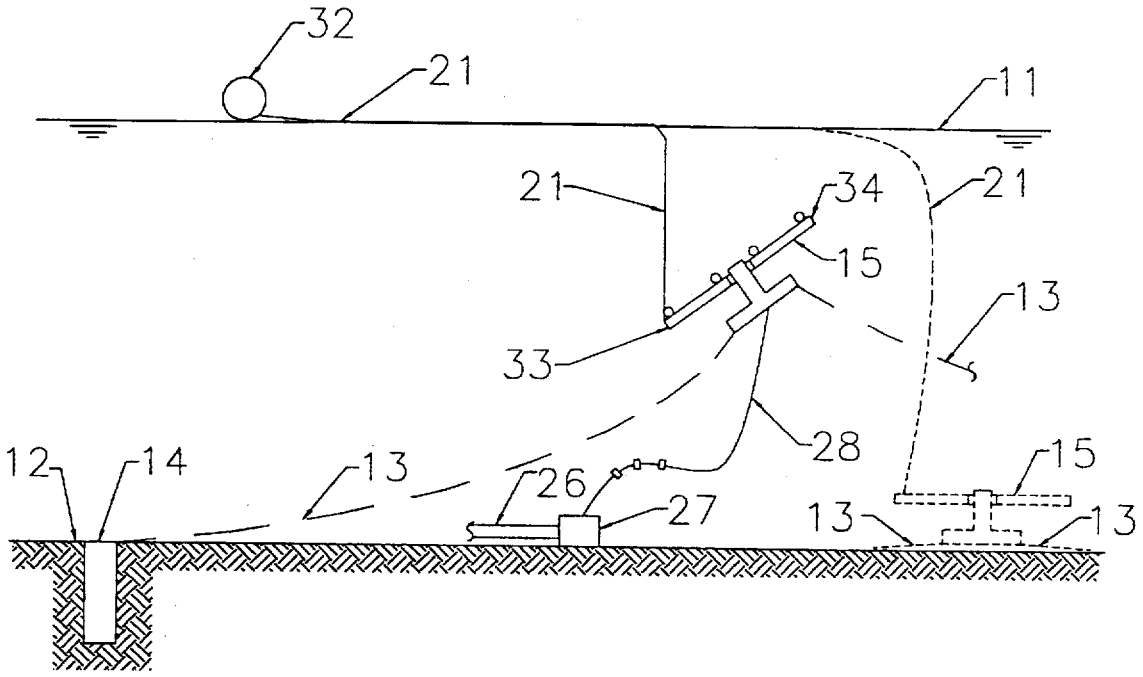
FIG. 2 shows the embodiment of FIG. 1, wherein the buoy is not attached to a vessel and submerged.

FIG. 2 shows the mooring element 15 in free floating condition when not moored to a vessel. In this condition the mooring element 15 floats such that the vertical forces from the mooring lines 13 and the riser 28 exactly equal the net buoyancy of the mooring element 15. The mooring lines 13 would normally have their centers of gravity below the upper part of the mooring element 15. The centers of gravity of the mooring lines 13 are thus seaward of the resilient seals 19, when the mooring element 15 is at the preselected depth of FIG. 2. Normally the mooring element 15 is designed to float below the surface 11 sufficiently deep that the mooring element is below the keel of passing vessels. The mooring element is unbalanced such that the attachment point 33 of the buoyant retrieval line 21 is at the lowermost point of the top surface of the mooring element 15. Diametrically opposite the retrieval line attachment point 33 is the uppermost point 34 of the mooring element 15. The flotation (not shown) in the mooring element 15 is disposed so as to cause the mooring element to tilt as shown in the free floating condition. To facilitate retrieval of the retrieval line 21 by a vessel (not shown) the retrieval line may be fitted with a marker buoy 32. The mooring element 15 can alternatively rest on the sea bed (dashed lines, FIG. 2) when not retrieved by the vessel.

Figure 3:
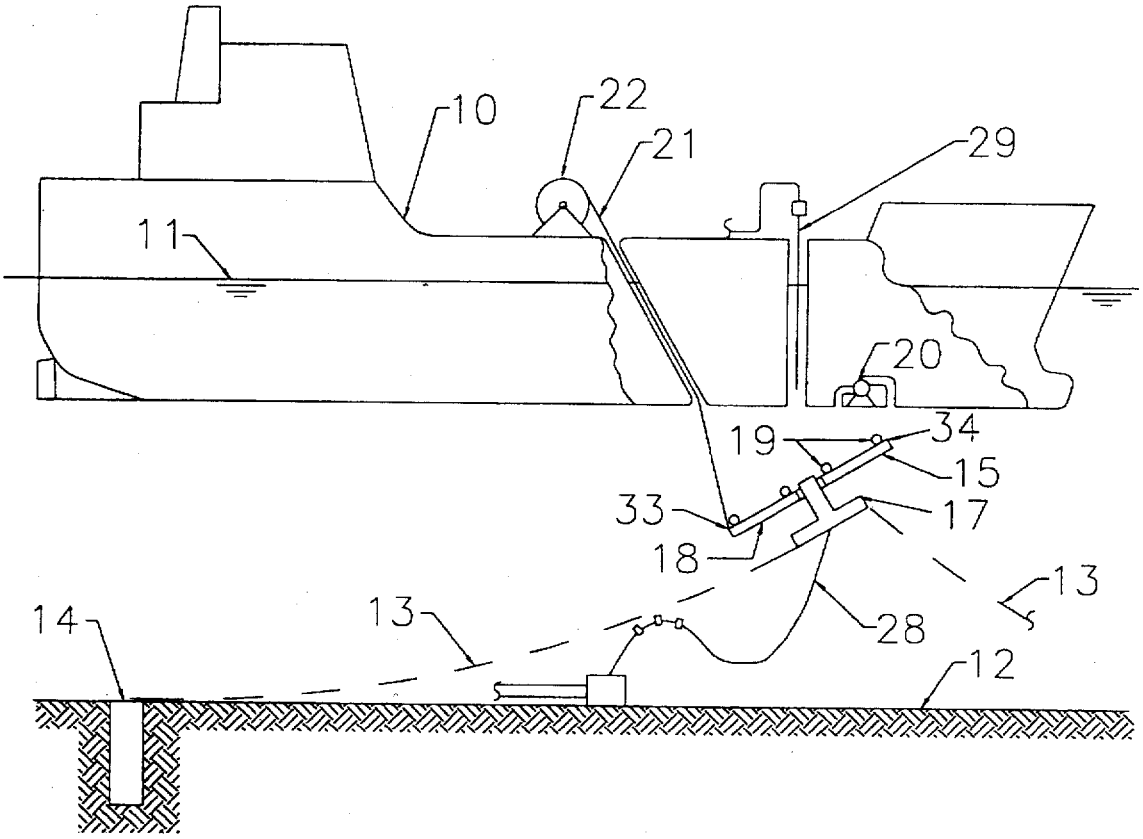
FIG. 3 shows the embodiment of FIG. 1, wherein the buoy is approaching the vessel to be attached to the vessel.

FIG. 3 shows the mooring element 15 being retrieved by the vessel 10 during the mooring process. When a force with a vertical component is applied to the retrieval line 21 from the vessel 10, the mooring element 15 rises in the water until anchor lines 13 and the riser 28 exactly counteract the vertical force. The horizontal component of the force from the retrieval line 21 on the mooring element causes one part 18 of the mooring element 15 to rotate relative to the other part 17 such that the part 18 becomes aligned with the horizontal projection of the retrieval line 21. In the absence of a force from the propulsion system (not shown) of the vessel 10 the alignment of the part 18 will, in most weather conditions, be nearly parallel to the longitudinal axis of the vessel 10.

As the mooring element 15 rises in response to the vertical force in retrieval rope 21 the mooring element 15 tilts less, however, it is designed such that when point 34 touches the vessel 10, point 33 is still some distance below point 34. Continued increasing pull on retrieval line 21 will then cause the mooring element 15 to pivot about point 34 until point 33 is also brought into contact with the hull of the vessel 10. If the mooring element 15 is in the proper orientation in relation to the vessel 10 then pump 20 is engaged. The pump 20 has a capacity which exceeds the leakage past the seals 19, with the consequence that the hydrostatic pressure above the mooring element 15 is lowered and the mooring element 15 is pressed onto the hull of the vessel 10. If the mooring element 15 is not in the proper orientation in relation to the vessel 10, the vessel's propulsion equipment (not shown) will be operated to effect the proper orientation, after which the pump 20 is engaged.

Figure 4:
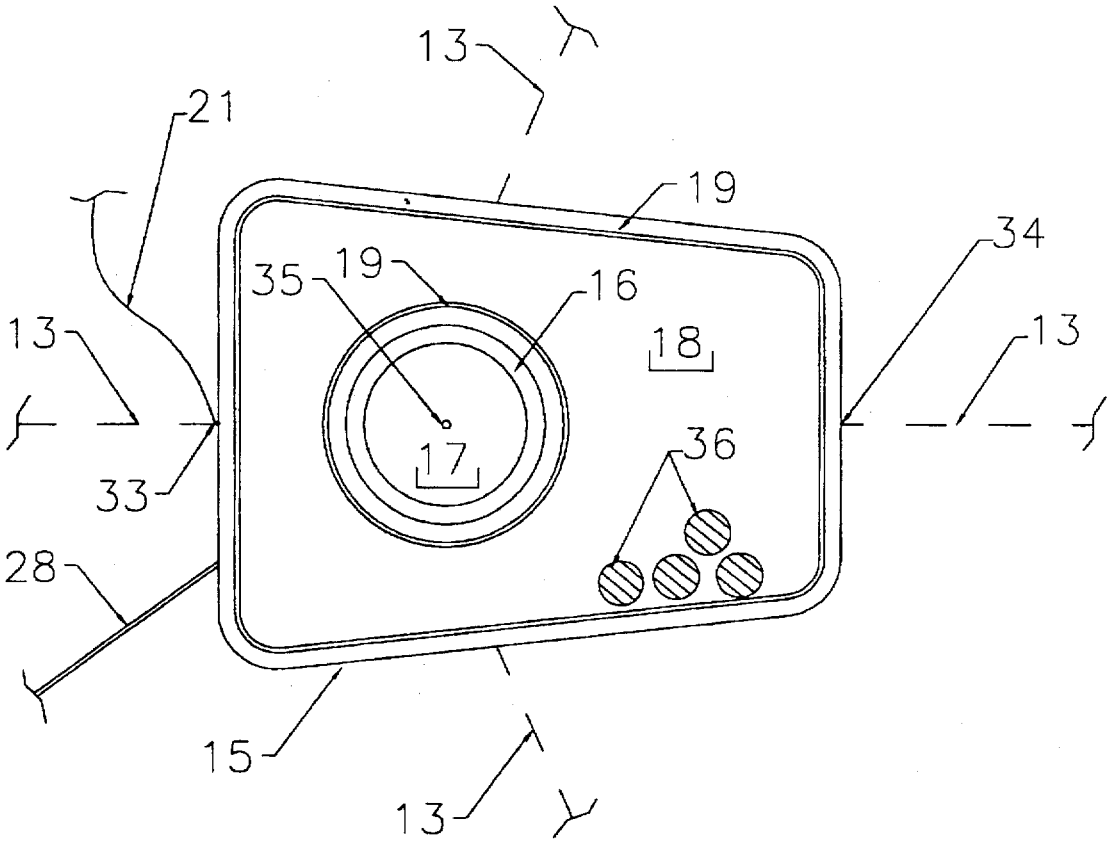
FIG. 4 is a top view of one embodiment of the buoy of the present invention.

FIG. 4 shows a plan view of the mooring element shown in FIGS. 1, 2, and 3. The plan view is looking obliquely down on the upper plane of the mooring element 15 in free floating condition as shown on FIG. 2. The form of the mooring element 15 is trapezoidal with rounded corners. However any other suitable shape such as triangular, rectangular, or oval could be used. The trapezoidal shape was chosen to conform to the tapered shape of the flat bottom of the vessel near the bow. The mooring element 15 consists of two parts 18 and 17 separated by the bearing 16. The part 18 is fitted with seals 19 that engage the mooring recess on the vessel to form a seal limiting the intrusion of seawater when engaged to the vessel. The mooring element 15 is shown fitted with four anchor lines 13. Any number of two or more anchor lines 13 could be used. Common numbers are 3, 5, 6, 8, and 12. The riser 28 is attached to fluid piping (not shown) penetrating the mooring element and terminating in the fluid coupler 35. The part 18 of the mooring element 15 is fitted with a number of elastic compression elements 36 within the area bordered by the seals 19 that transfer the compressive and friction forces between the mooring element 15 and the moored vessel, however, only a few of the elements 36 are shown and the rest have been omitted for clarity.

The buoyant retrieval rope 21 is attached at the lowest point 33 of the mooring element 15. The diametrically opposite point to point 33 of part 18 of the mooring element 15 is point 34, the highest point of the mooring element when floating freely in the submerged position shown on FIG. 2. The buoyant retrieval rope 21 is shown attached outside the seal 19. This is particularly advantageous because this prevents access of air and water to the mooring recess from the retrieval rope fairlead. However, the retrieval rope 21 can also be attached inside the area bordered by the seals 19.

Figure 5:
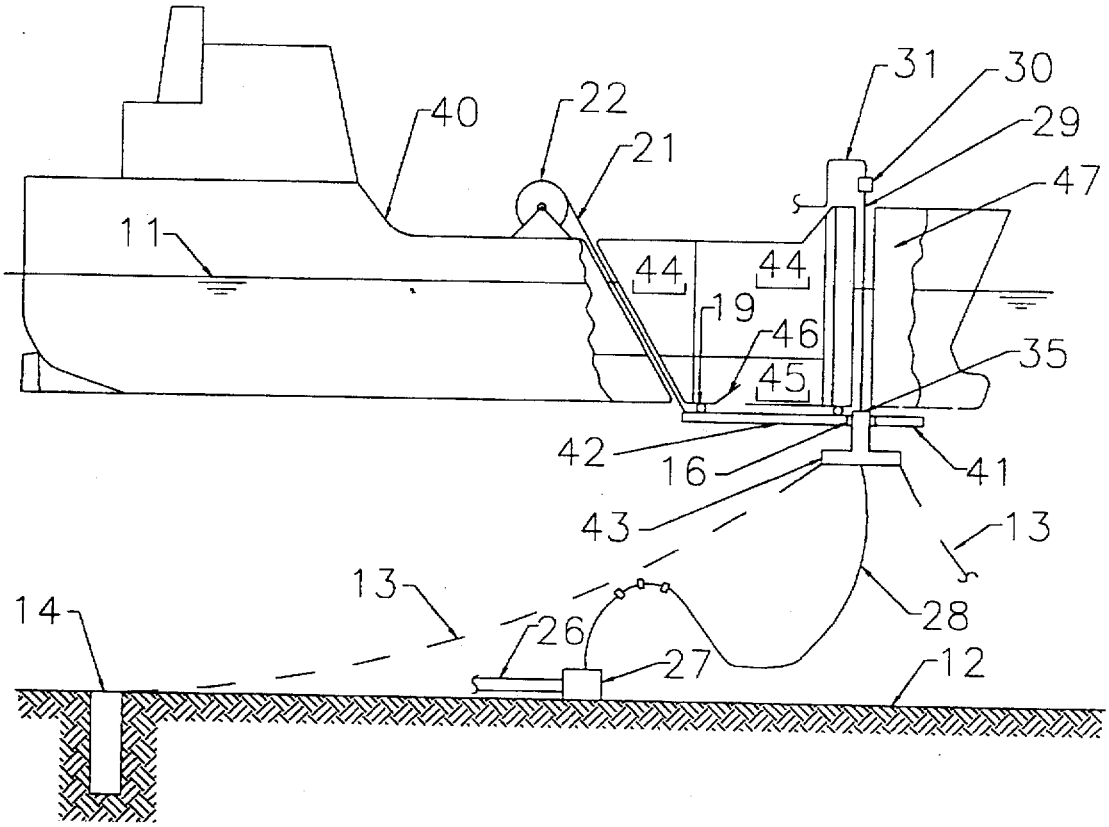
FIG. 5 is a side view of a second embodiment of the present invention, wherein the buoy is attached to the keel of a vessel.

FIG. 5 shows another embodiment of the invention. Vessel 40 is moored to a submersible mooring element 41 comprised of two parts 42 and 43 separated by a bearing 16. The vessel 40 is a tanker of the double hull design having cargo tanks 44 in the center of the vessel and ballast tanks 45 between the two double hulls. The mooring element 41 is of a configuration in which the fluid transfer coupling 35 is located outside the area bounded by the seals 19. The mooring element 41 is balanced in the same way as the mooring element in the embodiment illustrated in FIGS. 1, 2, and 3. Therefore when the mooring element 41 is retrieved by the winch 22 pulling on the retrieval rope 21 the mooring element is brought into parallel contact with the hull of the vessel 40. Prior to the mooring attempt ballast tank 45 is empty and may further be under vacuum by a vacuum pump (not shown). Opening valve 46 causes an inrush of water from the volume bordered by the seals 19, the hull of vessel 40 and the upper surface of part 42 of mooring element 41. The hydrostatic pressure is thereby lowered above the mooring element 41 and the mooring element 41 is pressed with large force onto the hull of vessel 40. Any water leaking past the seals 19 is removed by a pump (not shown) pumping from ballast tank 45. Liquid cargo is transferred as in the previous embodiment between the submarine pipeline 26, the pipeline end manifold 27, the riser 28, piping in the mooring element 41 (not shown), the fluid coupler 35, the coupling pipe 29, the fluid swivel 30, and the cargo piping 31 aboard the vessel 40. The vessel 40 can weather vane in response to changing weather conditions by rotating about the part 43 of the mooring element 41 through bearing 16. As in the previous embodiment the vessel 40 is moored to the seabed 12 through anchor lines 13 to anchors 14. Although the hydrostatic pressure is shown reduced by an empty ballast tank in this embodiment, any of the means described in U.S. Pat. No. 5,305,703 could be employed. A particular advantage of this embodiment is that the cargo transfer equipment 30 and 31 can be placed in the fore peak tank 47 of the vessel 40 or even outside the hull of vessel 40.

Figure 6:
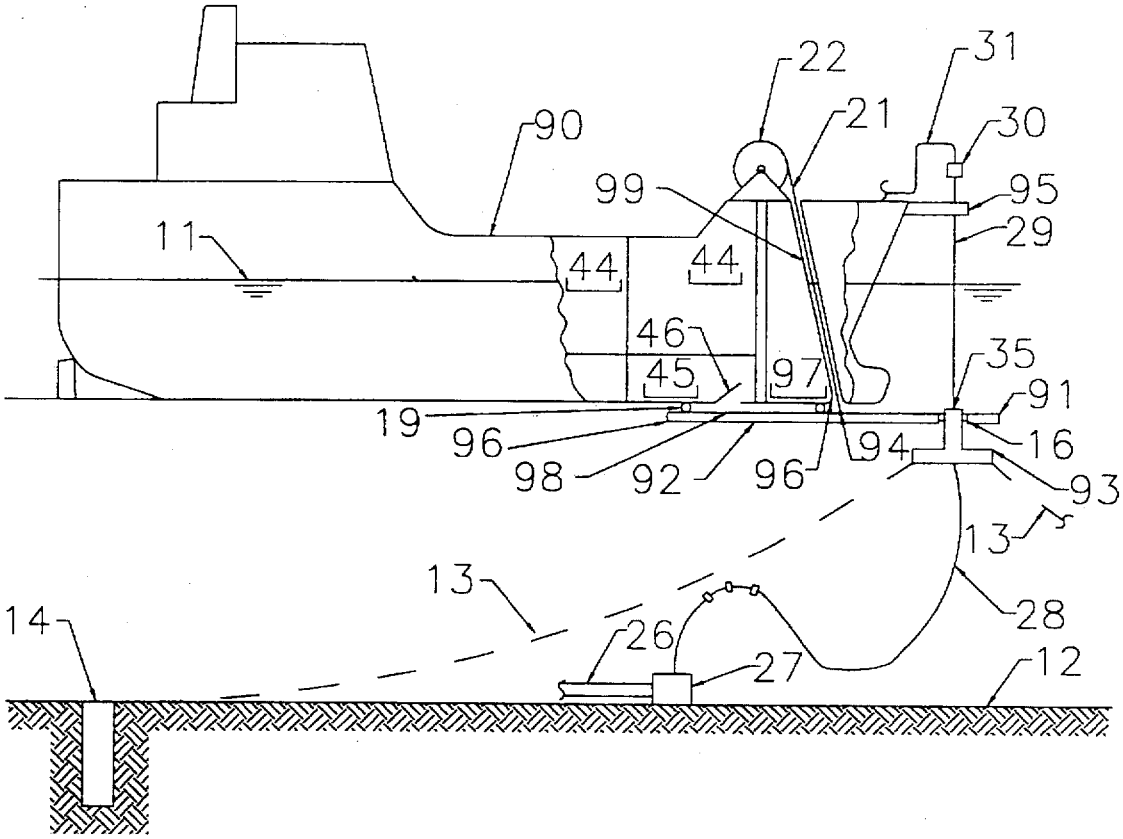
FIG. 6 is a side view of a third embodiment of the present invention, wherein the buoy is attached to the keel of a vessel.

FIG. 6 shows another embodiment of the invention. Vessel 90 is moored to a submersible mooring element 91 comprised of two parts 92 and 93 separated by a bearing 16. The vessel 90 is a tanker of the double hull design with cargo tanks 44 in the center of the vessel and ballast tanks 45 between the two hulls. The mooring element 91 in this embodiment has the bearing 16 and the fluid coupler 35 located forward of the hull of the vessel 90. The retrieval line 21 is attached at point 94 to the mooring element 91 aft of the bearing 16 but forward of the mooring recess 98.

The fluid transfer equipment connecting pipe 29 and fluid swivel 30 is shown deployed from a cantilevered platform 95 that is cantilevered from the bow of the vessel 90. This configuration eliminates the hull penetrations that are normally required for the fluid transfer equipment. The winch 22 pulls the retrieval line 21 through a fairlead 96 which is located in the fore peak tank 97 and a passage 99 connecting the fairlead and the winch. This arrangement is particularly advantageous in that penetration of cargo tanks 44 is completely avoided.

The mooring element 91 may float in a horizontal position (not shown) when free floating and not connected to the vessel 90. As the retrieval line 21 pulls the mooring element 91 up, then the mooring element tilts such that the point 96 is the first part of mooring element 91 to touch the hull of the vessel 90 while being retrieved by retrieval line 21. As the pull in the retrieval line 21 increases, the mooring element 91 pivots about point 96 and is brought up flush to the hull of the vessel 90 such that the sealing element 19 is brought into contact with the hull of the vessel 90. Valve 46 connecting the empty ballast tank 45 to the mooring recess 98 is then opened, causing the hydrostatic pressure in the mooring recess 98 to be lowered and the mooring element 91 pressed into the hull of vessel 90 with large force.

The embodiment of FIG. 6 is particularly advantageous in that it permits the mooring element 91 to float in near horizontal attitude when not connected to the vessel 90 and at the same time permits the mooring and fluid transfer equipment to be located forward of the cargo tanks 44 of the vessel 90.

Figure 7:
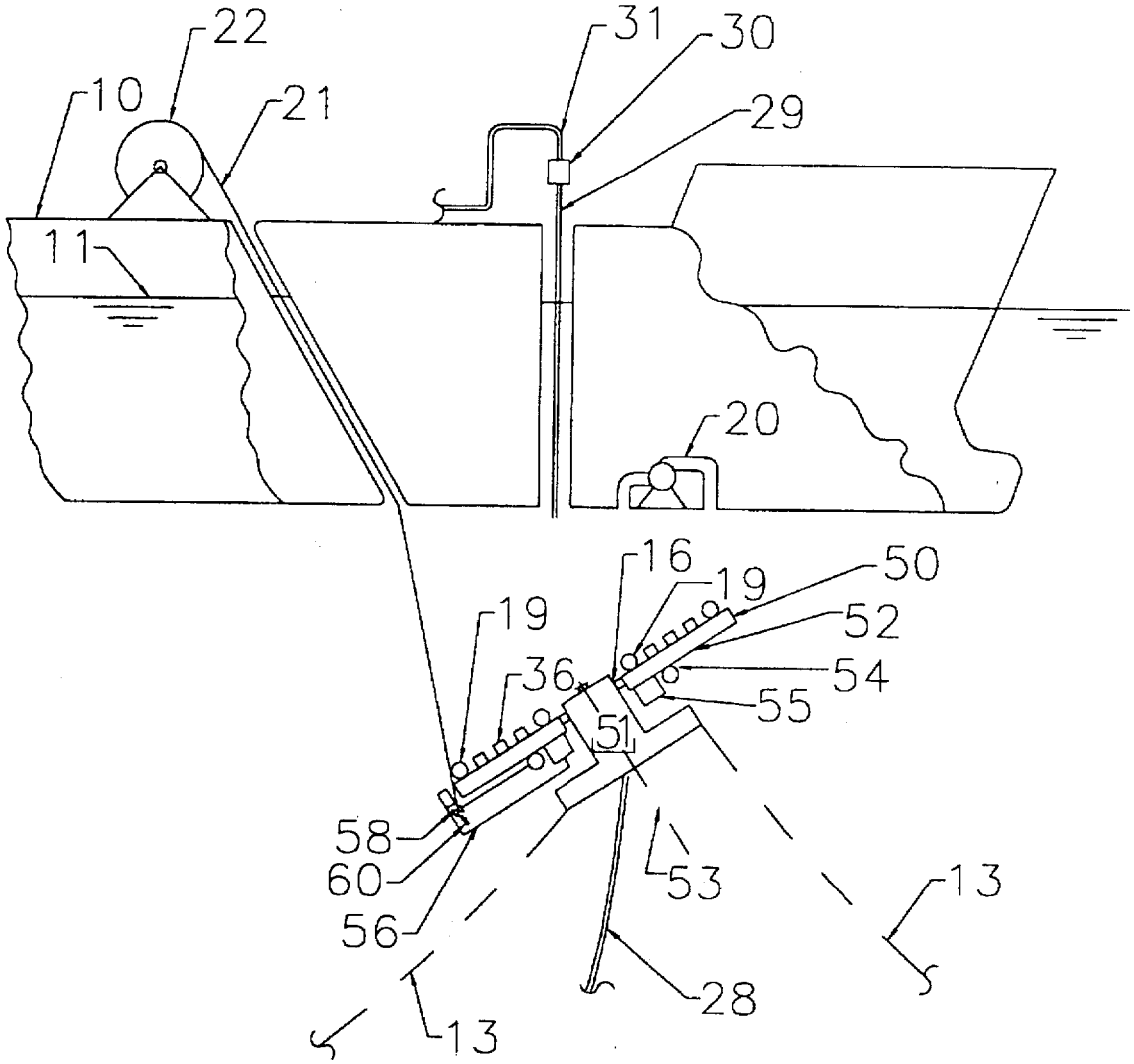
FIG. 7 is a side view of a fourth embodiment of the present invention, wherein the buoy is approaching the vessel to be attached to the vessel.

FIG. 7 shows yet another embodiment of the invention. The mooring element 50 is shown as being of similar configuration as the embodiment shown in FIG. 1. However, the mooring element in this embodiment can also be configured similarly to the embodiment in FIGS. 5 or 6. The mooring element 50 is shown while being retrieved by the vessel 10. As in previous embodiments, the mooring element 50 consists of two parts, 51 and 52, separated by the bearing 16 such that the two parts can rotate relative to one another about the rotation axis 53. The mooring element 50 is fitted with a compressed air tank 54 shown as a toroid with the axis 53. The mooring element 50 is fitted with a variable buoyancy tank 55, shown as a ring tank with the axis 53. The compressed air tank 54 is connected to the variable buoyancy tank 55 by a pipe 56. The pipe 56 incorporates a valve 58 which is actuated by a spring loaded actuator 60 opened by the pulling force in retrieval line 21. When the there is no pull in the retrieval line 21 valve 58 is closed. The variable buoyancy tank 55 is designed to be bleed a small amount of air continuously, thus in the stored position when no vessel is present the variable buoyancy tank 55 is full of water and has minimum buoyancy. As the pull in retrieval line 21 exceeds a certain minimum force valve 58 opens and compressed air starts flowing from tank 54 to tank 55 at a rate much higher than the rate of air bleeding out of tank 55. In consequence the mooring element 50 rises in the water.

When the mooring element 50 is brought into contact with the vessel valve 58 remains opened and the variable buoyancy tank 55 will be filled with air and reach maximum buoyancy. This action assists in engaging seals 19 by increasing the force with which they are pressed onto the hull. It is particularly advantageous to size the piping 56 such that the speed of rise of the mooring element 15 in the water from increasing buoyancy of tank 55 matches the speed of the winch 22. The compressed air tank 54 may be replenished by means not shown from the vessel 10, by means of divers, or by delivery via an umbilical (not shown) attached to the riser 28. Although both the compressed air tank 54 and the variable buoyancy tank 55 are shown fixed to the part 52 of the mooring element 50 that is rotationally fixed to the vessel 10, either or both could also be located in the part 51 anchored by anchor chains 13 to the sea bed.

Figure 8:
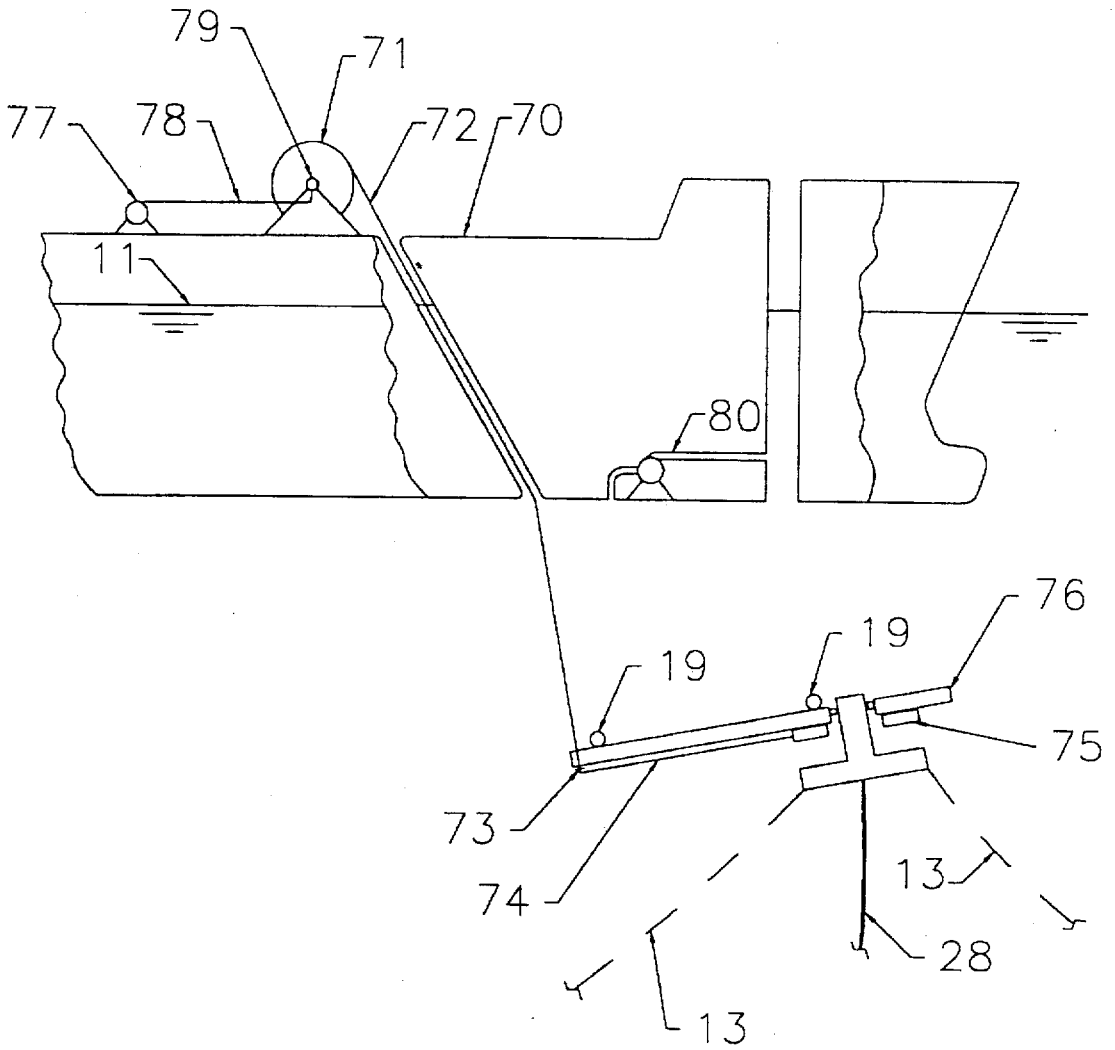
FIG. 8 is a side view of a fifth embodiment of the present invention, wherein the buoy is approaching the vessel to be attached to the vessel.

FIG. 8 shows another embodiment of the invention. A mooring element 76 similar in configuration to the mooring element shown in FIG. 5 is fitted with a variable buoyancy tank 75. The variable buoyancy tank is supplied with compressed air from pipe 74 that is coupled to the retrieval rope 72 at the coupling 73. The buoyant retrieval line 72 is a buoyant rope fitted with a high pressure air hose in the center. The retrieval rope 72 is reeled in on winch 71 in order to bring the mooring element 76 into contact with the vessel 70. Compressed air may be supplied from an air compressor 77 via piping 78 to a fluid swivel 79 to the drum of winch 71. The compressed air is conveyed to the retrieval line 72 via internal piping (not shown) and an aircoupler (not shown) in the drum of winch 71.

The compressed air is delivered to the variable buoyancy chamber 75 simultaneously with reeling in on winch 71. The increased buoyancy of the variable buoyancy chamber 75 assists in bringing the mooring element 76 up flat against the hull of vessel 70 as described for the embodiment in FIG. 7. When the mooring element 76 is brought into contact with the hull of vessel 70 and the proper alignment has been achieved pump 80 is engaged to reduce the hydrostatic pressure above the mooring element 76 thereby mooring the vessel 70.

Figure 9:
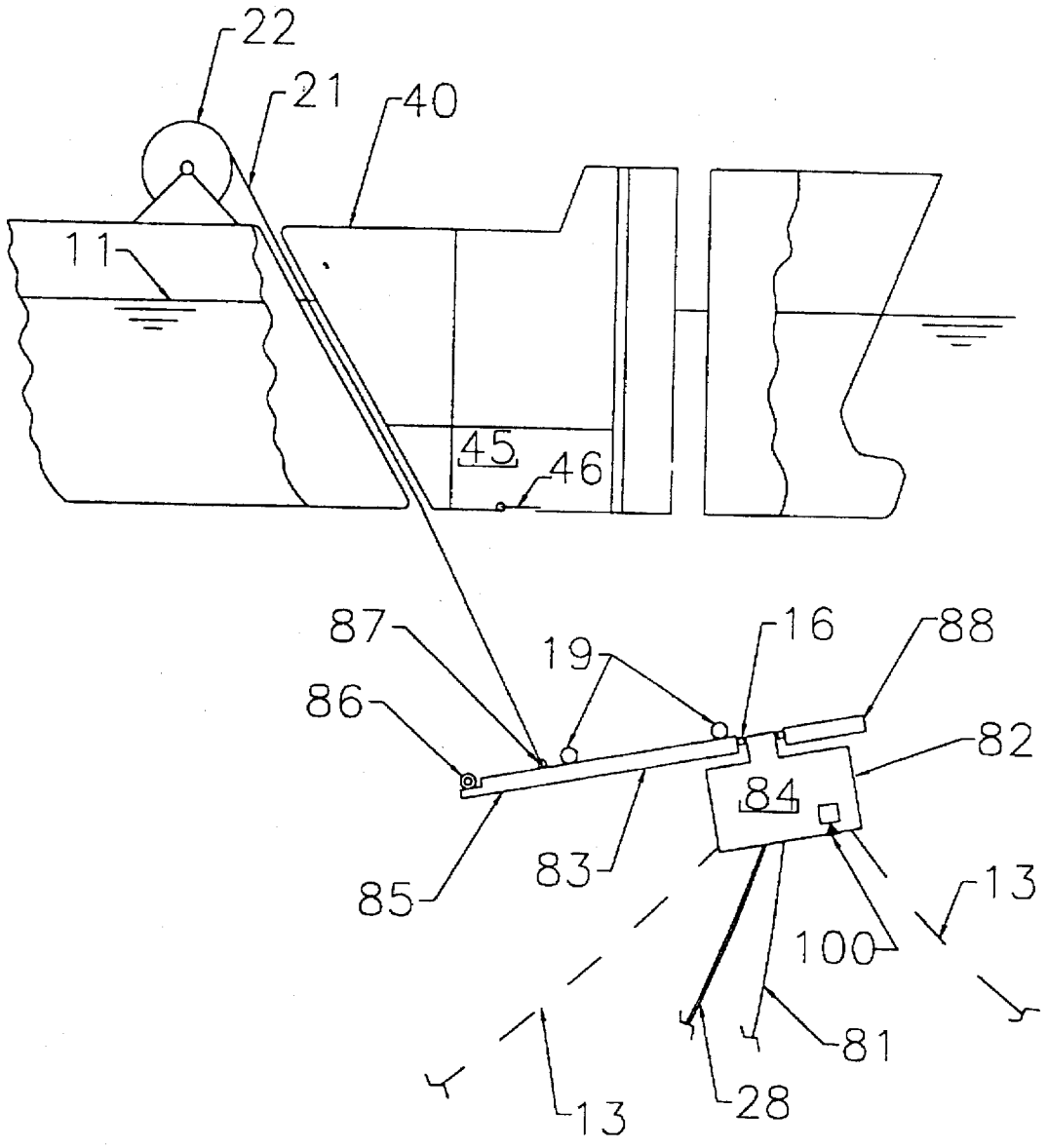
FIG. 9 is a side view of a sixth embodiment of the present invention, wherein the buoy is approaching the vessel to be attached to the vessel.

FIG. 9 shows yet another embodiment of the invention similar to the embodiment shown in FIG. 5. In this embodiment the mooring element 88 includes two parts 82 and 83 capable of rotating relative to one another through bearing 16. The part 82 which is moored to the seabed through anchor lines 13 incorporates a variable buoyancy tank 84 supplied with compressed air by an umbilical 81. The umbilical 81 rises from the pipeline end manifold (not shown) together with riser 28. The compressed air is supplied to the pipeline end manifold (not shown) by a submarine pipeline (not shown) parallel to the cargo pipeline (not shown) from the remote terminus point for the submarine pipeline. This point may be an oil platform, another mooring, or land. When vessel 40 tries to retrieve the mooring element 88 by pulling on retrieval line 21 it also communicates with the terminus point requesting that they supply compressed air to the variable buoyancy tank 84 thus assisting in the retrieval of the mooring element 88 by increasing the buoyancy of the variable buoyancy tank 84. This embodiment may include a compressed air storage tank 100 in the mooring element 88, valve systems (not shown) and telemetry devices (not shown) to enhance the reaction time and the control of the variable buoyancy tank 84.

FIG. 9 also shows an enhancement that may be applied to all previously described embodiments. The mooring element 88 includes an arm 85 that is cantilevered beyond the attachment point 87 of the retrieval line 21. The arm 85 is at its end fitted with a fender 86. In the event that the permanent buoyancy (not shown) and the variable buoyancy 84 is not sufficient to bring the mooring element 88 into parallel contact with the hull of vessel 40 then the retrieval line 21 will force the mooring element 88 to pivot about the fender 86 and thereby bring the mooring element 88 up flat against the hull of the vessel 40.

In all the embodiments of the invention the mooring element is described as having a free floating position below the surface where the net buoyancy of the mooring element equals the downward force from the anchor lines and the riser. However, in all embodiments the mooring element may also descend all the way to the sea bed when no vessel is moored thereto.

In the embodiments shown in FIGS. 7, 8, and 9 a tilt is shown on the figures which implies that the mooring element floats in a tilted position when in its free floating position below the surface. Because the ascent in these embodiments is assisted with variable flotation the element may float with a horizontal orientation and not have tilt. It would ordinarily be advantageous that the mooring element floats in a horizontal position.

A combination of embodiments may be employed in order to increase the redundancy of the systems required to assist in the mooring process. All the embodiments shown in FIGS. 7, 8, and 9 could be combined with the embodiment shown in FIG. 1, FIG. 5 or FIG. 6 to gain maximum reliability.

Once the vessel is moored by the differential hydrostatic pressure with the resultant friction, mechanical links may be established such as hydraulically tensioned chains, securing the mooring in the event of loss of the hydrostatic pressure differential.

While the invention has been described in the specification and illustrated in the drawings with reference to preferred embodiments, it will be understood by those skilled in the art that various changes may be made and equivalents may be substituted for elements of the invention without departing from the scope of the claims.

I claim:

1. An ocean mooring system comprising:

a vessel having a hull, said hull having a longitudinal axis;

a buoyant mooring element having an upper part engageable with said hull and forming a mooring recess between said hull and said upper part, said mooring element having a longitudinal axis;

a plurality of mooring lines connecting said mooring element to the ocean floor, the weight of said mooring lines acting on said mooring element so that said mooring element assumes a preselected depth below a bottom of said hull when not engaged with said hull;

a hoist, said hoist raising said mooring element from said preselected depth;

means for rotationally aligning said longitudinal axis of said mooring element with said longitudinal axis of said hull;

a source of reduced pressure, said source of reduced pressure rapidly drawing seawater from said mooring recess through an intake opening located within said mooring recess so as to reduce downward hydrostatic pressure acting on said upper part as said upper part engages said hull.

2. The ocean mooring system of claim 1, wherein:

said preselected depth is at the sea bed and said buoyant mooring element rests on said sea bed at said preselected depth.

3. The ocean mooring system of claim 1, wherein:

said source of reduced pressure comprises a pump, a first conduit connecting an inlet of said pump to said intake opening and a second conduit connecting an outlet of said pump to at least one discharge opening remote from said mooring recess.

4. The ocean mooring system of claim 1, wherein:

said source of reduced pressure comprises a hermetic chamber inside said hull, said hermetic chamber having a valve in said intake opening and a vacuum in said hermetic chamber.

5. The ocean mooring system of claim 1, wherein:

said source of reduced pressure comprises an empty hold in said hull, said hold having a valve opening in said intake opening.

6. The ocean mooring system of claim 1, wherein:

said hoist comprises a retrieval line attached to said mooring element.

7. The ocean mooring system of claim 1, wherein:

said mooring element comprises a center of rotation;

said means for aligning said mooring element with said hull comprises a retrieval line attached to said mooring element remote from said center of rotation.

8. The ocean mooring system of claim 7, wherein:

said upper part comprises at least one resilient member that makes sealing contact with said hull when said mooring element engages said hull.

9. The ocean mooring system of claim 8, wherein:

said resilient member completely surrounds said intake opening.

10. The ocean mooring system of claim 8, wherein:

said retrieval line is attached to said upper part on a seaward side of said resilient member, when said mooring element is at said preselected depth.

11. The ocean mooring system of claim 8, wherein:

the centers of gravity of said mooring lines are seaward of said resilient member, when said mooring element is at said preselected depth.

12. The ocean mooring system of claim 1, wherein:

said mooring element comprises a bearing, said means for aligning said mooring element with said hull comprises a retrieval line attached to said mooring element between said bearing and said mooring recess.

13. The ocean mooring system of claim 12, wherein:

said mooring element further comprises a lower part, said upper part being mounted on said lower part for rotation about a vertical axis, said mooring lines being connected to said lower part.

14. The ocean mooring system of claim 13, wherein:

said hoist comprises a variable buoyancy tank on said mooring element.

15. The ocean mooring system of claim 14, wherein:

said variable buoyancy tank may be filled by gas from a compressed gas storage tank in said mooring element.

16. The ocean mooring system of claim 15, further comprising:

a valve, said valve releasing gas from said compressed gas storage tank and into said variable buoyancy tank, said valve being actuated by tension on said retrieval line.

17. The ocean mooring system of claim 14, wherein:

said variable buoyancy tank is supplied with gas from an umbilical connecting said mooring element to a remote source of compressed gas.

18. The ocean mooring system of claim 14, wherein:

said variable buoyancy tank is supplied with gas from said vessel via a retrieval line, said retrieval line comprising a gas hose.

19. A method of mooring a vessel having a hull having a longitudinal axis comprising the steps of:

providing a buoyant mooring element, said mooring element having an upper part engageable with said hull to form a mooring recess, said mooring element having a longitudinal axis;

connecting said mooring element to the ocean floor with a plurality of mooring lines;

holding said mooring element at a preselected depth below said bottom of said hull;

raising said mooring element from said preselected depth;

rotationally aligning said longitudinal axis of said mooring element with said longitudinal axis of said hull; and engaging said mooring element with said hull by rapidly drawing seawater from said mooring recess through an intake opening located within said mooring recess so as to reduce downward hydrostatic pressure acting on an upper part of said mooring element.

20. The method of claim 19, wherein:

said step of holding said mooring element at a preselected depth comprises holding said mooring element at the sea bed so that said buoyant mooring element rests on said sea bed.

21. The method of claim 19, wherein:

said step of rapidly drawing seawater from said mooring recess comprises pumping said seawater from a first conduit, connected to said intake opening, to a second conduit, connected to at least one discharge opening remote from said mooring recess.

22. The method of claim 19, wherein:

said step of rapidly drawing seawater from said mooring recess comprises providing a hermetic chamber inside said hull, creating a vacuum said hermetic chamber, and opening a valve between said intake opening and said hermetic chamber.

23. The method of claim 19, wherein:

said step of rapidly drawing seawater from said mooring recess comprises providing an empty hold in said hull and opening a valve between said intake opening and said empty hold.

24. The method of claim 19, wherein:

said step of raising said mooring element from said preselected depth comprises hoisting a retrieval line attached to said mooring element.

25. The method of claim 19, wherein:

said step of aligning said mooring element with said hull comprises hoisting a retrieval line attached to said mooring element remote from a center of rotation of said mooring element.

26. The method of claim 19, wherein:

said mooring element comprises a bearing, and wherein said step of aligning said mooring element with said hull comprises hoisting a retrieval line attached to said mooring element between said bearing and said mooring recess.

27. The method of claim 19, wherein:

said step of raising said mooring element from said preselected depth comprises the steps of:

providing a variable buoyancy tank on said mooring element; and changing the buoyancy of said variable buoyancy tank.

28. The method of claim 27, wherein:

said step of changing the buoyancy of said variable buoyancy tank comprises filling said variable buoyancy tank with air from a compressed air storage tank in said mooring element.

29. The method of claim 28, wherein:

said step of providing a variable buoyancy tank comprises the step of providing a valve between said compressed air storage tank and said variable buoyancy tank; and wherein:

said step of filling said variable buoyancy tank comprises opening said valve to release compressed air from said compressed air storage tank and into said variable buoyancy tank.

30. The method of claim 29, wherein:

said step of opening said valve comprises actuating said valve by tension on a retrieval line.

31. The method of claim 27, wherein:

said step of changing the buoyancy of said variable buoyancy tank comprises supplying said variable buoyancy tank with compressed air from an umbilical connecting said mooring element to a remote source of compressed air.

32. The method of claim 27, wherein:

said step of changing the buoyancy of said variable buoyancy tank comprises supplying said variable buoyancy tank with compressed air from said vessel via a retrieval line comprising an air hose.

33. An ocean mooring system for mooring a vessel, the mooring system comprising:

a buoyant mooring element having an upper part with a resilient seal forming a mooring recess;

a plurality of mooring lines connecting said mooring element to the ocean floor;

a fluid transfer line including a fluid outlet, said fluid transfer line being connected to said buoyant mooring element; and a retrieval line connected to said upper part outside of said seal and said mooring recess.

34. The ocean mooring system of claim 33, wherein:

said retrieval line is connected to said upper part spaced from a center of rotation of said mooring element.

35. The ocean mooring system of claim 33, wherein:

said fluid outlet is inside, said mooring recess.

36. The ocean mooring system of claim 33, wherein:

said fluid outlet is outside said mooring recess.

37. The ocean mooring system of claim 33, wherein:

said retrieval line is connected to said upper part outside said mooring recess.

38. The ocean mooring system of claim 33, wherein:

said mooring element further comprises a lower part, said upper part being mounted on said lower part for rotation about a vertical axis, said mooring lines being connected to said lower part.

39. An ocean mooring system for mooring a vessel, the mooring system comprising:

a buoyant mooring element having an upper part with a seal forming a mooring recess engageable with the vessel, said upper part being non-circular in a plane perpendicular to a rotation axis of said mooring element;

a plurality of mooring lines connecting said mooring element to the ocean floor;

a fluid transfer line including a fluid outlet, said fluid transfer line being connected to said buoyant mooring element; and a retrieval line connected to said upper part.

40. An ocean mooring system comprising:

a buoyant mooring element having an upper part with a seal forming a mooring recess;

a plurality of mooring lines connecting said mooring element to the ocean floor;

a fluid transfer line including a fluid outlet, said fluid transfer line being connected to said buoyant mooring element; and a retrieval line connected to said upper part outside of said seal and said mooring recess;

wherein said mooring element comprises a bearing, and wherein said retrieval line is attached to said mooring element between said bearing and said mooring recess.

* * * * *